US010883214B2

(12) United States Patent
Ronchi

(10) Patent No.: US 10,883,214 B2
(45) Date of Patent: Jan. 5, 2021

(54) OXIDATION INTENSIFIER DEVICE FOR INDIGO DYEING SYSTEMS

(71) Applicant: KARL MAYER R&D GMBH, Obertshausen (DE)

(72) Inventor: Francesco Ronchi, Sovico (IT)

(73) Assignee: KARL MAYER R&D GMBH, Obertshausen (DE)

( * ) Notice: Subject to any disclaimer, the term of this patent is extended or adjusted under 35 U.S.C. 154(b) by 246 days.

(21) Appl. No.: 15/999,005

(22) PCT Filed: Feb. 21, 2017

(86) PCT No.: PCT/IB2017/050975
§ 371 (c)(1),
(2) Date: Aug. 20, 2018

(87) PCT Pub. No.: WO2017/145045
PCT Pub. Date: Aug. 31, 2017

(65) Prior Publication Data

US 2019/0093271 A1 Mar. 28, 2019

(30) Foreign Application Priority Data

Feb. 22, 2016 (IT) ..... 102016000017924

(51) Int. Cl.
*D06B 5/06* (2006.01)
*D06B 19/00* (2006.01)
(Continued)

(52) U.S. Cl.
CPC ..... *D06B 5/06* (2013.01); *D06B 19/0017* (2013.01); *D06P 1/228* (2013.01); *D06P 3/6025* (2013.01)

(58) Field of Classification Search
CPC ..... D06B 5/06; D06B 5/08; D06B 19/0017; D06B 3/04; D06P 1/228; D06P 3/6025
(Continued)

(56) References Cited

U.S. PATENT DOCUMENTS 3,429,057 A 2/1969 Thygeson
4,173,077 A * 11/1979 Birke ..... D06C 7/00 34/462

(Continued)

FOREIGN PATENT DOCUMENTS

CN 101018902 A 8/2007
DE 4223556 A1 1/1994

(Continued)

OTHER PUBLICATIONS

International Search Report for corresponding application PCT/IB2017/050975 filed Feb. 21, 2017; dated Jun. 12, 2017.

(Continued)

*Primary Examiner* — Tinsae B Ayalew
(74) *Attorney, Agent, or Firm* — Cantor Colburn LLP

(57) ABSTRACT

An oxidation intensifier device for a continuous dyeing system for dyeing a warp thread, the device arranged for being mounted in the oxidation assembly of the dyeing system and comprises two blowing assemblies having a substantially identical shape and opposed one another, each blowing assembly is provided with at least one respective fan and, downstream of such a fan, with a respective plurality of convergent conduits arranged along development directions that are parallel and transversal to the feeding direction of the warp thread, the convergent conduits of a first blowing assembly converge in a opposite direction with respect to the convergence direction of the convergent conduits of the opposite blowing assembly, each convergent conduit is configured to face parallel to a single lap of the (Continued)

warp thread moving inside the dyeing system and is provided with a plurality of longitudinal slots oriented along the same development direction of the respective convergent conduit, where each fan is hydraulically connected to the plurality of convergent conduits of the respective blowing assembly and is configured to convey air towards the plurality of longitudinal slots, so that a plurality of opposite air laminar flows is generated, which generate a plurality of turbulences adapted to facilitate the oxidation process of the dyed warp thread on both its surfaces.

11 Claims, 4 Drawing Sheets

(51) Int. Cl.
*D06P 1/22* (2006.01)
*D06P 3/60* (2006.01)

(58) Field of Classification Search
USPC ..... 68/5 D, 9, 12.07, 19.1, 20, 22 R; 15/316.1; 34/638
See application file for complete search history.

(56) References Cited

U.S. PATENT DOCUMENTS

| | | | | |
|---|---|---|---|---|
| 4,227,317 | A | 10/1980 | Fleissner | |
| 4,320,587 | A | 3/1982 | Vits | |
| 4,505,053 | A | 3/1985 | Andersson | |
| 5,337,586 | A * | 8/1994 | Ronchi ..... | D06B 3/04 15/316.1 |

FOREIGN PATENT DOCUMENTS

| | | | |
|---|---|---|---|
| EP | 0533286 | A1 | 3/1993 |
| JP | S5029897 | U | 4/1975 |
| JP | S5637480 | U | 4/1981 |
| JP | S5883175 | U | 6/1983 |
| JP | S6262175 | U | 4/1987 |
| JP | H08502121 | A | 3/1996 |
| WO | 2007080134 | A1 | 7/2007 |

OTHER PUBLICATIONS

Written Opinion of the International Searching Authority for corresponding application PCT/IB2017/050975 filed Feb. 21, 2017; dated Jun. 12, 2017.

JP Office Action dated Oct. 22, 2020 re: Application No. 2018-544122, pp. 1-5, citing: EP00533286, U.S. Pat. No. 3,429,057, U.S. Pat. no. 4,320,587 JPS58-083175, JPS50-029897, JPH08-502121, JPJPS56-037480, JPS62-062175, CN101018902.

* cited by examiner

OXIDATION INTENSIFIER DEVICE FOR INDIGO DYEING SYSTEMS

TECHNICAL FIELD

The present disclosure relates to a device applicable to continuous flat dyeing systems for dyeing warp yarns for denim fabrics, with indigo dye, to intensify and complete the oxidation of such yarns after each single dye.

BACKGROUND

As is known, denim is the fabric used for making jeans and sportswear articles in general, and is the quantitatively most produced fabric in the world. Consequently, indigo is the most consumed dye in the world.

Classic denim, or fabric for jeans, is manufactured by weaving previously dyed cotton threads. In particular, only the warp is dyed continuously with indigo, while the weft is used raw. Typically and traditionally, the dyeing of warp yarns for denim fabrics is carried out in open vat and at low temperature, using indigo as the dye, with both the so-called "rope" system, in which the yarn is twisted into multiple longitudinal ropes of some hundreds of yarns, and with the so-called "open width" system, in which the yarns are lying next to each other by their entire width.

Indigo is an ancient natural dye of plant origin, but for over a century it has also been produced by chemical synthesis. The indigo dye is characteristic in the particular dyeing process required for its application to the cotton yarn. This dye, in fact, composed of relatively small molecules and characterised by a low affinity with cellulose fibres, requires for its application to these fibres to be not only chemically reduced in an alkaline solution (in "leuko" form), but also a plurality of impregnation operations alternated with squeezing and subsequent oxidation in air.

Therefore, in order to obtain a "blue denim" with a medium or dark colour intensity, it is necessary to subject the yarn to a first dyeing, divided into the impregnation, squeezing and oxidation steps, immediately followed by several over-dyeing operations, the more numerous the darker are the shades of colour to be obtained and the higher the strength of application to the yarn. The dyeing process mentioned above is applied in all dyeing machines and systems in a continuous cycle with indigo of warp chains, both in the rope system and in the open width system.

In open width dyeing system, dyeing machines are connected in line to a sizing machine, which provides to sizing, drying and twisting of the dyed yarn on a beam, so as to prepare it for subsequent processing on a weaving loom. These dyeing machines should be constructed respecting determined basic parameters relative to the yarn immersion and oxidation times. This is to allow an optimal absorption of the bath to the yarn and, after squeezing, a complete oxidation before entering the next vat, in order to darken its colour tone. In practice, however, each manufacturer uses different parameters from its competitors and therefore these parameters are highly variable. Moreover, very often the users require specific parameters to adapt the results that can be obtained to their particular needs.

The immersion times of the yarn in the dye bath ranges from about 8 seconds to about 20 seconds, while the times for the oxidation of the yarn itself, after squeezing, ranges from about 60 seconds to about 80 seconds. This means that the yarn must remain exposed to air for about 60-80 seconds before it is again immersed in the next vat. This exposure time to air is repeated for all the vats of the dyeing system.

The average dyeing speed can be considered variable from 25 to 40 metres per minute. Consequently, for each dyeing vat, the amount of yarn immersed in the bath is on average equal to about 4-11 metres, while the amount of yarn exposed to air between one vat and the other ranges from about 30 to 40 metres.

Therefore, taking as an example a machine with eight dyeing vats, the yarn drawn in the dyeing vats alone and in the relative oxidation equipment can reach a considerable length. The maximum length of the yarn, in this case, is equal to 408 metres according to the following formula: [(11 metres×8)+(40 metres×8)]. This length of the yarn, with the addition of minor amounts due to the drawing in other parts of the system (pre-treatment vats and final washings of the yarn, sizing machine, etc.), actually reaches a total of about 500/600 metres, which contributes to making the control of the system more difficult. In addition, at each batch change, the amount of yarn corresponding to said length must be considered lost, since it is not dyed uniformly because of problems relating to the beginning of the new batch.

Albeit in very much smaller amounts than in the classic blue or black jeans, the market also requires jeans and similar garments having different colours, usually produced with dyes made with other classes of dyes. The dyeing systems described above, therefore, must also be suitable for dyeing processes with other dyes, such as sulphur dyes, indanthrone blue and reagents which, for their application, require different methodologies than those of indigo. The flexibility and adaptability of such dyeing systems to procedures different from that of indigo dyeing are required not to excessively increase the costs associated with the installation of specific dyeing systems.

In order to reduce the metres of yarn exposed to the air for oxidation between one dyeing and the other, so as to significantly reduce waste upon batch change, an oxidation intensifier device has been implemented, consisting of a large-diameter centrifugal fan. This centrifugal fan, which is only one for the entire dyeing system, is connected to a longitudinal manifold pipe from which, for each dyeing vat, two blowing pipes branch off transversely and horizontally, which send air above and below of dyed warp thread. This system has however proved inefficient both due to the non-uniformity of the air flow between the different dyeing vats, and due to the large load losses of the air flow itself.

Another oxidation intensifier device is described in document EP 0533286 A1 in the name of the same applicant. In this device, for each dyeing vat it is provided to use two opposing tangential fans that blow air in a direction substantially transversal to the feeding direction of the yarn.

In order to reduce the number of dyeing vats not only to reduce waste at each batch change but substantially also the cost and the overall dimensions of the dyeing system, a dyeing system and a process have been implemented such as those illustrated in document EP 1971713 A1, again in the name of the same applicant. The traditional dyeing process with indigo, common to all known dyeing systems, essentially provides three operating steps which are repeated several times:

1. impregnation of the yarn with the leuko;
2. squeezing for removing excess bath in the yarn; and
3. oxidation by exposure of the dyed yarn to air.

The dyeing process illustrated in document EP 1971713 A1 has added a fourth operating step, which consists in the diffusion/fixation of leuko in an inert environment, an environment in which immersing and squeezing of the yarn are also carried.

By operating in an inert environment, the chemical reduction of indigo is total and perfect, even if used in a smaller number of vats and therefore with higher percentages than is the case with air dyeing baths. In addition, leuko is disintegrated into particles of nanometer size. This increased dyeing capacity of leuko makes it penetrate and attach to the fibre in a quantitatively greater manner than is the case in the traditional dyeing process. This feature of leuko, together with the continuous demands of increase of the operating speed of dyeing systems, has further highlighted the limitations and the inadequacy of current oxidation intensification devices as described above.

Further oxidation intensification devices for continuous dyeing systems of yarns are described, for example, in documents U.S. Pat. Nos. 3,429,057 A, 4,505,053, 4,227,317 and 4,320,587. However, none of these devices is provided with equipment capable of dynamically adjusting in real time the air speed and flow rate to be blown onto the warp thread.

In the light of the above, the need of having dyeing systems and processes that allow significantly reducing the waste of yarn between each batch change, and the sizes and consequently the cost of the systems themselves, is clear. In particular, the need of having a new oxidation intensifier device of indigo dye that allows perfect, deep and complete oxidation both with traditional air dyes and with the new dyeing processes in an inert environment, even at maximum working speeds, is clear. It should be noted that the better the oxidation, the smaller the discharge of indigo from the yarn in the dyeing bath between one vat and the other, to the advantage of a higher dyeing yield.

BRIEF SUMMARY

The disclosure provides an oxidation intensifier device for indigo dyeing systems which is capable of solving the above drawbacks of the prior art in an extremely simple, cost-effective and particularly functional manner.

In detail, the disclosure provides an oxidation intensifier device for indigo dyeing systems which allows considerably reducing the length of the dyed yarn which, between one dyeing and the other, must be exposed to air for oxidation, so as to therefore reduce both waste at each batch change, and energy consumption.

The disclosure further provides an oxidation intensifier device for indigo dyeing systems where the length of the dyed yarn subjected to ventilation is higher than the current one, thus with a greater air/yarn interchange time without having to increase the length of the dyeing system.

The disclosure further provides an oxidation intensifier device for indigo dyeing systems where the dyed yarn is not simply impinged in a single horizontal section by a single opposite vertical air flow, but is instead impinged in a variable manner, in a plurality of vertical sections, by a plurality of opposite horizontal flows.

The disclosure further provides an oxidation intensifier device for indigo dyeing systems where the air is not blown in free air onto the yarn, but is instead channeled into a multiplicity of convergent conduits, whose multiple longitudinal slots are able to generate a series of opposed laminar flow that in turn generate a series of full-width turbulences adapted to facilitate the oxidative process.

The disclosure further provides an oxidation intensifier device for indigo dyeing systems the construction of which, with horizontally opposite convergent conduits, facilitates its application to standard oxidation equipment of dyeing systems, being able to be positioned between the vertical laps of the yarn without having to change the path of the yarn itself, as is required by current oxidation intensifier devices.

The disclosure further provides an oxidation intensifier device for indigo dyeing systems which, depending on the specific features of the various dyeing processes, can allow, by means of inverters, not only the quantitative variation of the air flow but also the variation of the air/yarn interchange time by increasing or exclusion, with known means, of one or more convergent conduits.

BRIEF DESCRIPTION OF THE DRAWINGS

The features and the advantages of an oxidation intensifier device for indigo dyeing systems according to the present disclosure will become apparent from the following exemplary and non-limiting description, made with reference to the accompanying schematic drawings, in which.

DETAILED DESCRIPTION

Figure 1:
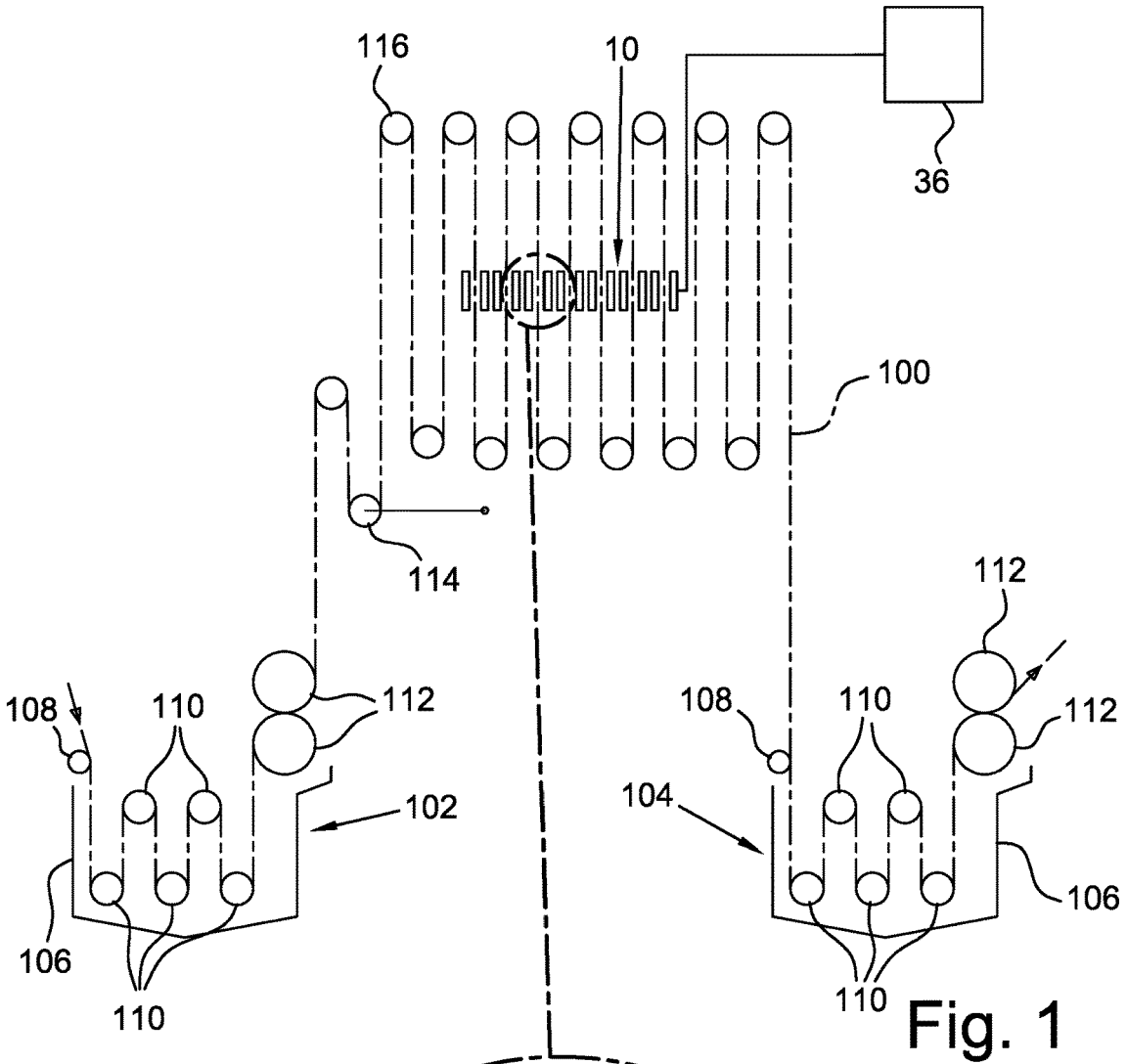
FIG. 1 is a schematic view of a generic dyeing system provided with two dyeing/squeezing assemblies, between which an oxidation intensifier device according to the present disclosure is arranged.

With reference in particular to FIG. 1, the oxidation intensifier device according to the present disclosure, generally indicated with reference numeral 10, is installed in the space between two dyeing/squeezing assemblies 102 and 104 of a continuous dyeing system for threads, in particular a system which operates according to the open width dyeing system. Each of the dyeing/squeezing assemblies 102 and 104 comprises a respective impregnation vat 106 in which a warp thread 100, which advances in the direction of the arrows indicated in FIG. 1, is introduced in a dye bath. The dye bath may consist, for example, of an alkaline solution of indigo dye.

The warp thread 100 arrives in each vat 102 and 104 passing over a respective guide roller 108 and is then immersed in the vat itself by twisting on a plurality of return rollers 110. At the exit of each vat 102 and 104, the warp thread 100 undergoes a squeezing by passing between a pair of squeezing rollers 112.

Figure 3:
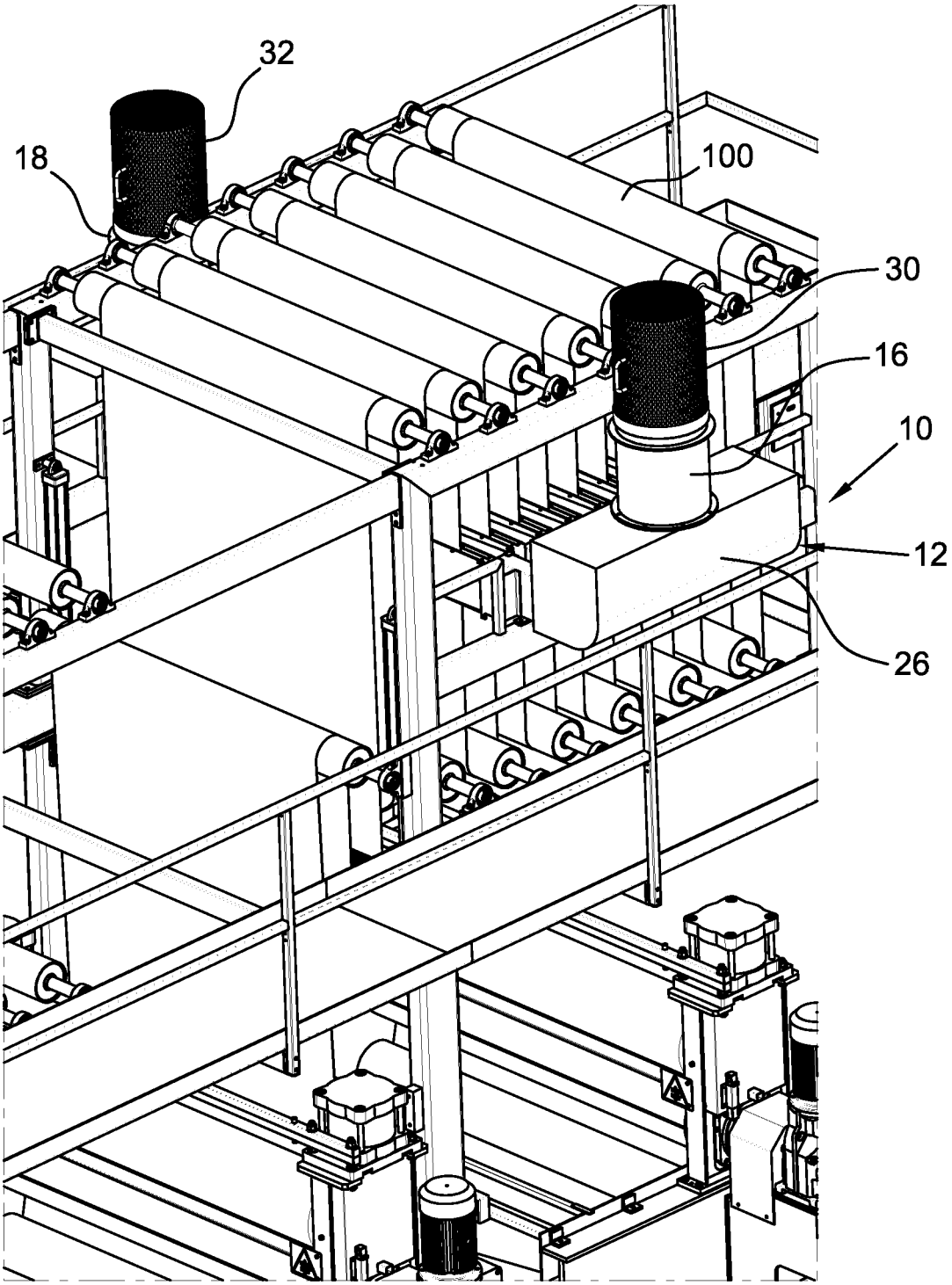
FIG. 3 shows an oxidation intensifier device according to the present disclosure installed on a generic dyeing system.

The oxidation of the warp thread 100 is carried out in the area of the dyeing system interposed between the pair of squeezing rollers 112 at the outlet of a first vat 102 and the guide roller 108 associated with the next vat 104. In this oxidation assembly or area, downstream of a suitable movable tensioning roller 114 for tensioning the warp thread 100 and for the synchronism of the drive motors of the squeezing cylinders 112 of the two vats 102 and 104, a plurality of return rollers 116 is provided, configured to arrange the warp thread 100, which is in continuous movement, on a plurality of vertical planes parallel to each other (see FIG. 3), so as to increase the surface thereof exposed to air.

Figure 4:
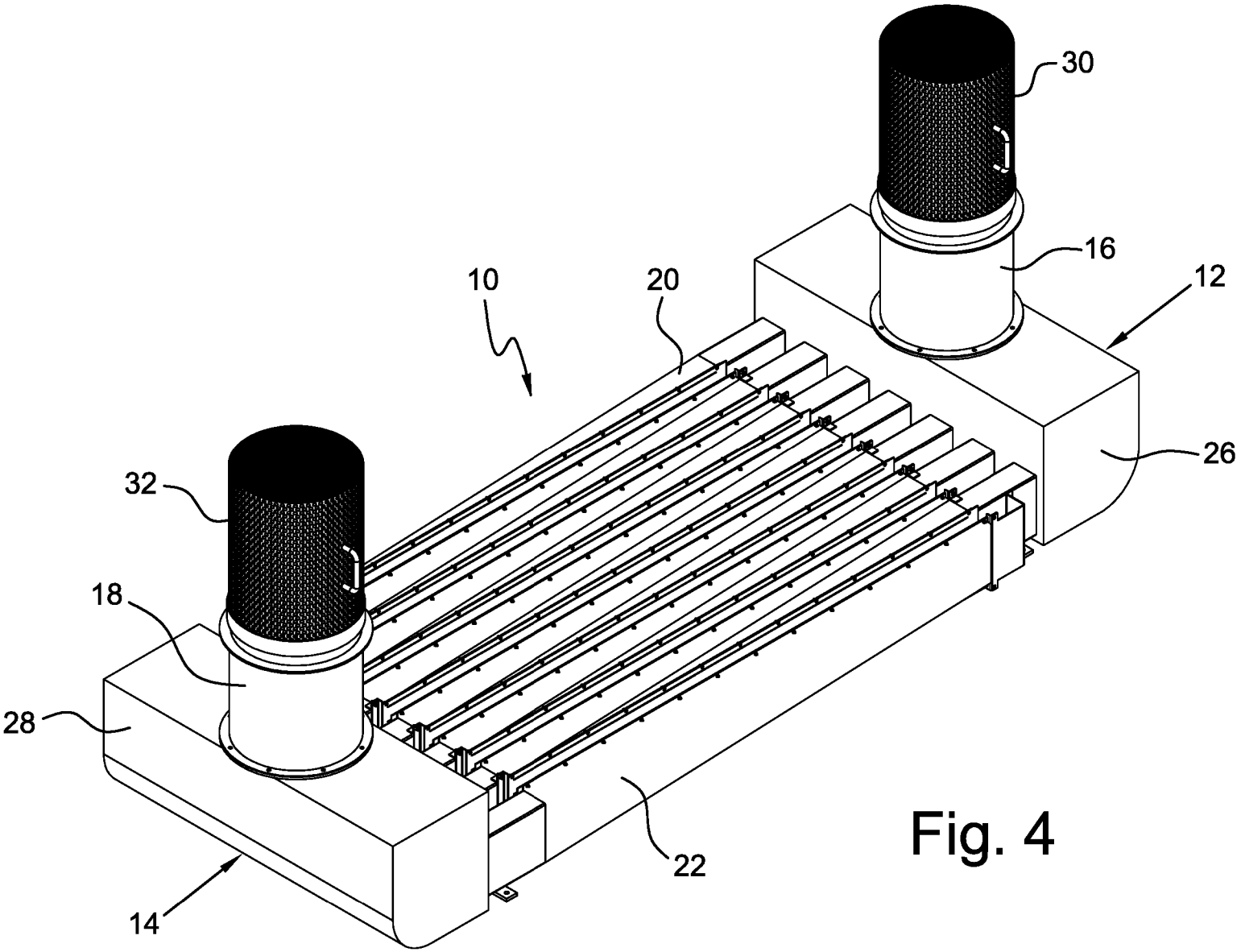
FIG. 4 is a perspective view of the oxidation intensifier device of FIG. 3.

The oxidation intensifier device 10 is mounted in the system dyeing zone in which oxidation of the warp thread 100 is carried out, i.e. in the oxidation assembly of the dyeing system itself. As shown in FIG. 4, such an oxidation intensifier device 10 consists of two blowing assemblies 12 and 14 having a substantially identical shape and opposed one another.

Each blowing assembly 12 and 14 is provided with at least one respective fan 16 and 18, preferably an axial fan and even more preferably a ducted axial fan. It is however not excluded that each fan 16 and 18 may be of a different type, such as a centrifugal fan, an axial fan or a helico-centrifugal fan. It is not even excluded that each blowing assembly 12 and 14 can be provided with a plurality of fans different from one another.

Each blowing assembly 12 and 14 is further provided, downstream of the respective fan 16 and 18, with a respective plurality of convergent conduits 20 and 22, preferably arranged equally spaced from each other and along development directions that are transversal to the feeding direction of the warp thread 100 in the dyeing system. As shown in FIG. 4, although being arranged along parallel development directions, the convergent conduits 20 of a first blowing assembly 12 converge in a opposite direction with respect to the convergence direction of the convergent conduits 22 of the opposite blowing assembly 14.

Figure 5:
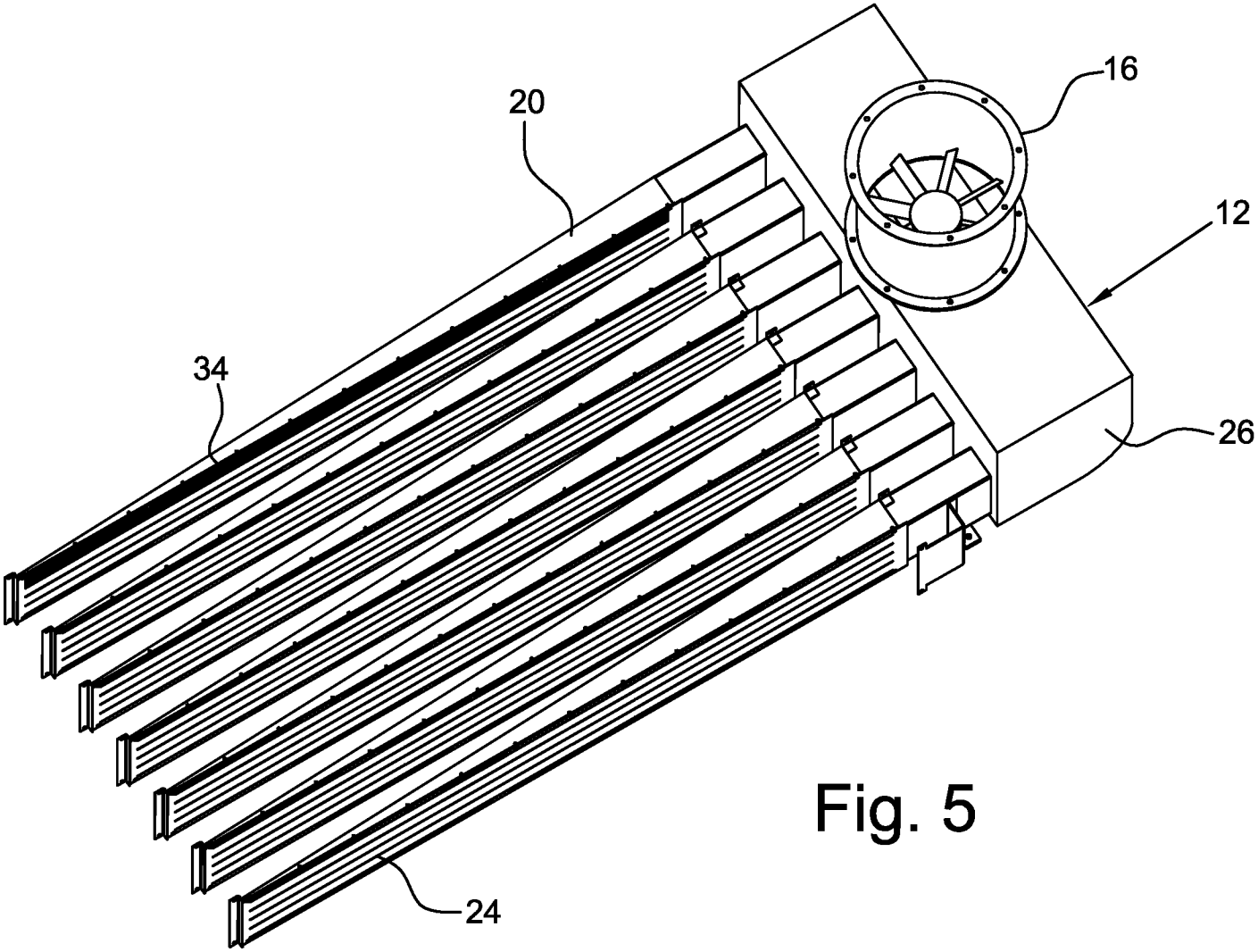
FIG. 5 is a perspective view of a part of the oxidation intensifier device of FIG. 3, which shows the development of the convergent conduits and of the respective longitudinal slots.

Each convergent conduit 20 and 22 is configured to face parallel to a single vertical lap of the warp thread 100 moving inside the dyeing system and is in turn provided with a plurality of longitudinal slots 24, i.e. oriented along the same development direction of the respective convergent conduit 20 and 22 (see FIG. 5). Each fan 16 and 18 is hydraulically connected to the plurality of convergent conduits of the respective blowing assembly 12 and 14 and is configured to convey air, taken from the environment in which the dyeing system works, towards the plurality of longitudinal slots 24. In this way, a plurality of opposite air laminar flows is generated through the longitudinal slots 24 of the two separate blowing assemblies 12 and 14, which in turn generate a plurality of turbulences adapted to facilitate the oxidation process of the dyed warp thread 100 on both its surfaces.

In detail, based on the embodiment example of the oxidation intensifier device 10 shown in the figures, each blowing assembly 12 and 14 is provided with a single fan 16 and 18 configured to suck and release air along a direction which is substantially perpendicular to the development direction of the respective convergent conduits 20 and 22. At least one conveying chamber 26 and 28 is interposed between fan 16 and 18 and the convergent conduits 20 and 22 of each blowing assembly 12 and 14 which, in the specific embodiment example shown in the figures, is configured for deviating the air flow by an angle of about 90°.

In any case, conveying chambers having a different shape may be provided, configured for deviating the air flow according to different methods depending on the construction and size requirements of the dyeing system. For example, each fan 16 and 18 may be directly mounted on the front head of the respective conveying chamber 26 and 28 in such a way as to be configured to suck and release air along a direction which is substantially parallel to the development direction of the respective convergent conduits 20 and 22.

Each fan 16 and 18 may be provided with a respective filter 30 and 32, preferably arranged upstream of the blades of fan 16 and 18 itself, configured to remove any solid particles from the air entering the convergent conduits 20 and 22. This prevents dirt and various impurities from being blown on the warp thread 100 as these could adversely affect the dyeing steps.

Figure 2:
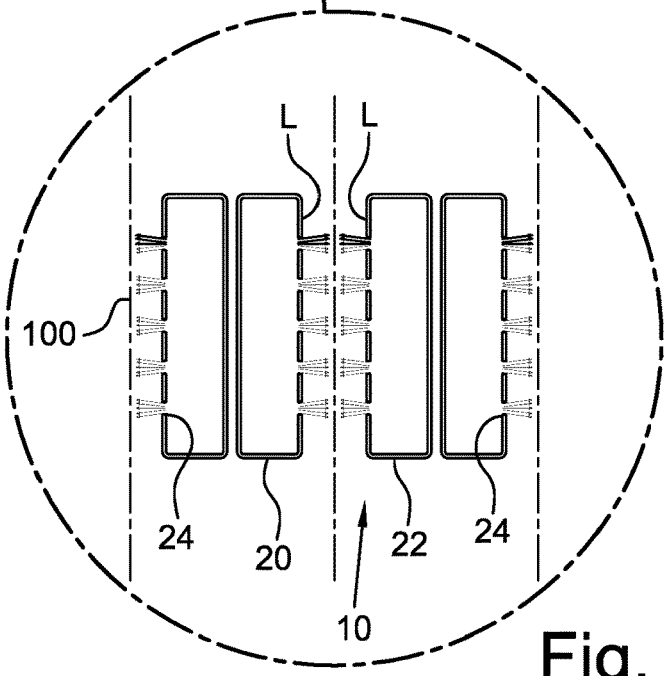
FIG. 2 is a detailed view of an enlarged detail of FIG. 1.

Each convergent conduit 20 and 22 preferably has a rectangular cross-section, where the long side L of the rectangle of the convergent conduit 20 of a first blowing assembly 12 faces parallel both to the surface of the warp thread 100 and to the corresponding long side L of the rectangle of the convergent conduit 22 of the opposite blowing assembly 14 (see enlarged detail in FIG. 2). This reduces the transverse dimensions (with reference to the feeding direction of the warp thread 100 in the dyeing system) of the entire oxidation intensifier device 10, while allowing a smooth movement of the warp thread 100 in the interstices present between the various convergent conduits 20 and 22 facing each other. In this way, a mutual spacing of the return rollers 116 is not required as compared to the traditional configurations of the dyeing systems. It is however not excluded that the cross section of the convergent conduits 20 and 22 may be of other shape, provided it is compatible with the air speed and flow rate to be blown onto the warp thread 100, as well as with the technical and dimensional features of the dyeing system.

The air speed and flow rate to be blown onto the warp thread 100 are adjusted dynamically and in real time by an electronic control system 36, which can be installed both on the oxidation intensifier device 10, and on the dyeing system as part of the control electronics of the dyeing system itself. In particular, the electronic control system 36 is configured both to adjust the operating parameters of fans 16 and 18 and to control the opening and closing of the longitudinal slots 24 of the convergent conduits 20 and 22.

The opening and closing of the longitudinal slots 24 is controlled by the electronic control system 36 and is carried out through respective shutters 34 with which at least a part of the convergent conduits 20 and 22 is provided at the respective longitudinal slots 24. The quantitative variation of the air flow dispensed by the oxidation intensifier device 10 therefore affects the air/yarn interchange time, allowing the dyeing system to be adapted to the specific features of the various dyeing processes.

The oxidation intensifier device for indigo dyeing systems of the present disclosure thus conceived can be subjected to numerous modifications and variants, all falling within the same inventive concept; moreover, all details may be replaced with technically equivalent elements. In the practice, the materials used as well as shapes and sizes, may be any, according to the technical requirements.

The invention claimed is:

1. Oxidation intensifier device for a continuous dyeing system for dyeing a warp thread, the device being arranged for being mounted in an oxidation assembly of the dyeing system and comprising two blowing assemblies having a substantially identical shape and being opposed one another, each blowing assembly being provided with at least one respective fan, the device being wherein:

each blowing assembly is provided, downstream of the respective fan, with a respective plurality of convergent conduits arranged along development directions that are parallel and transversal to the feeding direction of the warp thread in the dyeing system;

the convergent conduits of a first blowing assembly converge in a opposite direction with respect to the convergence direction of the convergent conduits of the opposite blowing assembly;

each convergent conduit is configured to face parallel to a single lap of the warp thread moving inside the dyeing system;

each convergent conduit is provided with a plurality of longitudinal slots, that are oriented along the same development direction as of the respective convergent conduit;

each fan is hydraulically connected to the plurality of convergent conduits of the respective blowing assembly and is configured to convey air, which has been drawn from the environment where the dyeing system operates, towards the plurality of longitudinal slots, a plurality of opposite air laminar flows being generated through said longitudinal slots, said opposite air laminar flows generating a plurality of turbulences adapted to facilitate the oxidation process of the dyed warp thread on both its surfaces;

at least a part of the convergent conduits is provided with respective shutters placed at the respective longitudinal slots; and the device comprises an electronic control system configured to dynamically adjust, in real time, through the operating parameters of the fans, the air speed and flow rate to be blown on the warp thread, said electronic control system being further configured to control the opening and closing of the longitudinal slots of said convergent conduits through the respective shutters.

2. Device according to claim 1, wherein the convergent conduits are arranged equally spaced from one another.

3. Device according to claim 1, wherein each fan is an axial fan.

4. Device according to claim 3, wherein each fan is an axial ducted fan.

5. Device according to claim 1, wherein each fan comprises at least one of a centrifugal fan, an axial fan and a mixed-flow fan.

6. Device according to claim 3, wherein said fan provided with each blowing assembly is configured to suck and release air along a direction which is perpendicular to the development direction of the respective convergent conduits.

7. Device according to claim 6, wherein at least one conveying chamber is interposed between the fan and the convergent conduits of each blowing assembly, said chamber being configured to deviate the air flow by an angle of 90°.

8. Device according to claim 3, wherein said fan provided with each blowing assembly is configured to suck and release air along a direction which is parallel to the development direction of the respective convergent conduits.

9. Device according to anyone of the preceding claims, wherein each fan is provided with a respective filter configured to remove any solid particles from the air entering the convergent conduits.

10. Device according to claim 9, wherein the filter is arranged upwards of the blades of the respective fan.

11. Device according to claim 1, wherein each convergent conduit has a rectangular cross-section, where the long side of the rectangle of the convergent conduit of a first blowing assembly faces in a parallel way both the surface of the warp thread and the corresponding long side of the rectangle of the convergent conduit of the opposed blowing assembly.

* * * * *